United States Patent [19]

Langner

[11] Patent Number: 4,712,447

[45] Date of Patent: Dec. 15, 1987

[54] OSCILLATOR FOR A CONTINUOUS CASTING MOLD

[75] Inventor: Carl Langner, Monsey, N.Y.

[73] Assignee: SMS Concast Inc., Montvale, N.J.

[21] Appl. No.: 855,883

[22] Filed: Apr. 24, 1986

[51] Int. Cl.[4] ..... G05G 3/00; B22D 11/04

[52] U.S. Cl. ..... 74/571 R; 74/571 M; 164/478; 164/71.1; 164/260; 164/416

[58] Field of Search ..... 164/478, 416, 71.1, 164/260; 74/571 R, 571 M

[56] References Cited

U.S. PATENT DOCUMENTS

| | | | |
|---|---|---|---|
| 3,292,215 | 5/1964 | Taylor et al. . | |
| 3,402,621 | 9/1968 | Johnson et al. | 74/571 R |
| 3,798,996 | 3/1974 | Kirschmann | 74/571 M |
| 4,020,703 | 5/1977 | Bartel et al. . | |
| 4,022,082 | 5/1977 | Uchimoto | 74/805 |

FOREIGN PATENT DOCUMENTS

| | | |
|---|---|---|
| 2008080 | 1/1972 | Fed. Rep. of Germany . |
| 2545386 | 9/1976 | Fed. Rep. of Germany . |
| 951334 | 3/1964 | United Kingdom . |
| 973723 | 10/1964 | United Kingdom . |
| 1054909 | 1/1967 | United Kingdom . |

*Primary Examiner*—M. Jordan
*Assistant Examiner*—Samuel M. Heinrich
*Attorney, Agent, or Firm*—Peter K. Kontler; Tobias Lewenstein

[57] ABSTRACT

An oscillator for a continuous casting mold includes a rotatable drive shaft having first and second portions which are eccentric with respect to one another. A sleeve for inducing oscillatory motion of the mold rotatably surrounds the second shaft portion and is eccentric with reference to the latter as well as the first shaft portion. The sleeve is coupled to the housing of a gear reducer having a gear assembly which is rotatable relative to the housing and is coupled to the drive shaft for rotation therewith. The housing is, in turn, connected with the casing of a motor having an output shaft which is rotatable relative to the casing and is coupled to the gear assembly. This motor constitutes an auxiliary motor which is operable independently of a primary motor for the drive shaft. During normal operation, the auxiliary motor is deactivated and the sleeve, gear reducer and auxiliary motor all rotate with the drive shaft as this induces reciprocation of the mold through the agency of the sleeve. If the magnitude of the oscillation stroke is to be changed, the auxiliary motor is activated. This causes the sleeve to rotate relative to the drive shaft so that the eccentricity of the sleeve with respect to the first portion of the drive shaft, which determines the magnitude of the oscillation stroke, changes. The auxiliary motor and the gear reducer are at least approximately coaxial with the first portion of the drive shaft thereby enabling the auxiliary motor to be small and the oscillator to be compact.

29 Claims, 2 Drawing Figures

OSCILLATOR FOR A CONTINUOUS CASTING MOLD

BACKGROUND OF THE INVENTION

The invention relates generally to an oscillator for a continuous casting mold.

More particularly, the invention relates to an oscillator of the type which can be remotely adjusted so as to change the oscillation stroke.

In the continuous casting of steel, only a thin layer of steel adjacent to the walls of the mold undergoes solidification in the mold. The continuously cast strand withdrawn from the mold thus consists of a thin outer shell surrounding a molten core. Since the shell is not only thin but is also at a very high temperature, it is relatively weak so that care must be exercised to limit the stress which is applied to the shell in order to withdraw the strand from the mold. Excessive stress will cause the shell to rupture. Rupture of the shell inside the mold is bad for the surface quality of the strand while rupture outside of the mold will result in a breakout, i.e., an escape of the molten core.

The shell has a tendency to stick to the mold. Inasmuch as sticking of the shell to the mold can increase the withdrawal stress sufficiently to cause rupture of the shell, it has become the practice to oscillate or reciprocate the mold during casting. Mold oscillation prevents sticking of the shell to the mold.

Although sticking is prevented by mold oscillation, there is nevertheless friction between the shell and the mold. To avoid rupture of the shell, the friction must not be allowed to become excessive.

The friction between the shell and the mold is affected by a number of factors, e.g., temperature, which can change during a casting operation. The friction is likewise a function of the oscillation stroke. Thus, it is possible to control the friction via the oscillation stroke.

Modern machines for the continuous casting of steel are equipped with instrumentation for indicating the friction between the shell and the mold. These machines are also designed such that the oscillation stroke and frequency can be adjusted. The frequency is remotely adjustable by changing the rpm of the main oscillator motor which may, for example, be achieved by the use of a d.c. motor and related speed controls.

The oscillation stroke in currently available machines is adjustable only when the oscillator drive is at a standstill. The adjustment may be performed manually or remotely but, in either case, requires casting to be stopped thereby resulting in lost production time.

OBJECTS AND SUMMARY OF THE INVENTION

It is an object of the invention to provide an oscillator which enables the oscillation stroke to be adjusted in a practical manner without interrupting reciprocation of the mold.

Another object of the invention is to provide an oscillator which permits the oscillation stroke to be remotely adjusted during mold reciprocation and at standstill yet may have a relatively compact design.

An additional object of the invention is to provide an oscillator which may have a relatively simple design while nevertheless allowing remote adjustment of the oscillation stroke to be performed during mold reciprocation and at standstill.

A further object of the invention is to provide an oscillator which enables remote adjustment of the oscillation stroke to be achieved during mold reciprocation and at standstill with relatively little power consumption.

It is also an object of the invention to provide an oscillator which makes it possible to remotely and steplessly adjust the oscillation stroke during mold reciprocation and at standstill.

The preceding objects, as well as others which will become apparent as the description proceeds, are achieved by the invention.

An oscillator according to the invention for reciprocating a continuous casting mold comprises a rotary drive shaft having a first portion, and a second portion which is eccentric with respect to the first portion. A first motor is provided to rotate the drive shaft. The oscillator further comprises a sleeve which surrounds and is rotatable relative to the second shaft portion. This sleeve is eccentric with respect to both portions of the shaft and is designed to transmit oscillatory motion to a continuous casting mold as the drive shaft rotates. The oscillator additionally comprises a varying mechanism for changing the oscillation stroke while the drive shaft rotates and while the drive shaft is at a standstill. The varying mechanism includes a second motor having an output element, e.g., an output shaft, and a supporting element, e.g., a casing, for the output element. The output element and the supporting element are rotatable relative to one another. One of these elements is coupled to the sleeve for rotation therewith while the sleeve is rotatable relative to the other of the elements so as to permit the second motor to rotate the sleeve relative to the second shaft portion. Both the output element and the supporting element are at least approximately coaxial with the first shaft portion.

In the oscillator of the invention, the oscillation stroke is determined by the resultant of: (i) the eccentricity of the second shaft portion with respect to the first shaft portion; and (ii) the eccentricity of the sleeve with respect to the second shaft portion. The resultant eccentricity can be changed by rotating the sleeve relative to the drive shaft. This change in the resultant eccentricity, and hence a change in the oscillation stroke, may be performed without interrupting reciprocation of the mold due to the provision of a first motor for the drive shaft and a second motor for the sleeve. The first motor, which is responsible for mold reciprocation, may thus operate while the oscillation stroke is changed via the second motor. Furthermore, the mounting of the second motor so as to be at least approximately coaxial with the first shaft portion enables the oscillator to have a relatively simple and compact design. Such mounting of the second motor also permits the oscillation stroke to be changed with relatively little power consumption since the second motor is arranged in-line with the sleeve. The connection between the second motor and the sleeve may accordingly be a relatively simple one which does not result in substantial power losses or backlash.

The second drive motor may be designed so as to permit stepless adjustment of its rpm. Furthermore, the second drive motor may be remotely controlled. Complete remote and stepless adjustment of the oscillation stroke may then be achieved in a fully automatic manner without interrupting mold reciprocation and at any speed of the first drive motor.

The invention makes it possible to record and/or program stroke/frequency parameters for various cast metals at different temperatures and casting speeds, and to record the influence of such parameters on mold sticking and surface quality of the strand. In addition, the invention enables a substantially constant value of negative strip to be maintained as the casting speed varies.

The novel features which are considered as characteristic of the invention are set forth in particular in the appended claims. The improved oscillator itself, however, both as to its construction and its mode of operation, together with additional features and advantages thereof, will be best understood upon perusal of the following detailed description of certain specific embodiments with reference to the accompanying drawings.

DESCRIPTION OF THE PREFERRED EMBODIMENTS

Figure 1:
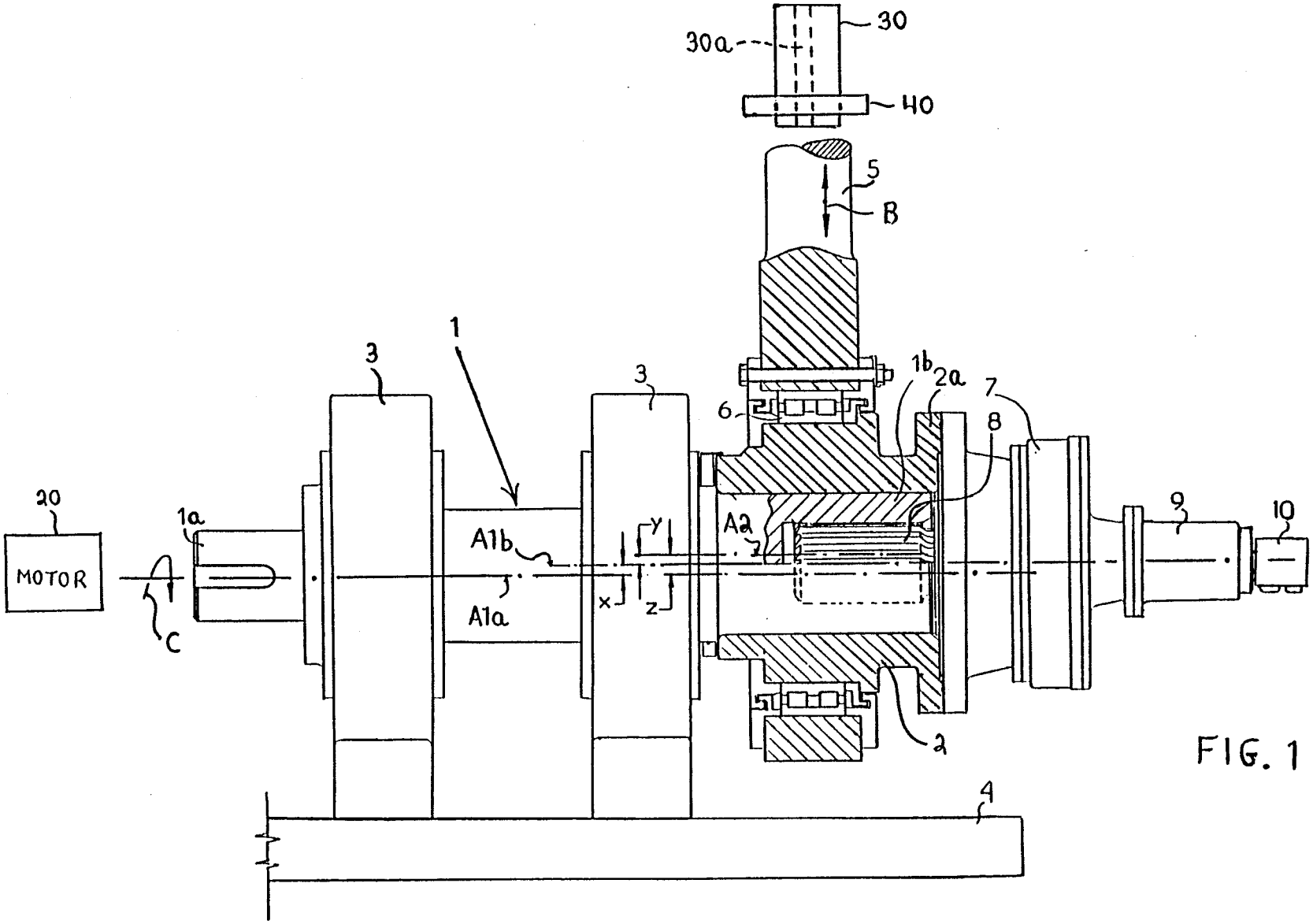
FIG. 1 is a partly sectional elevational view of an oscillator according to the invention.

FIG. 1 illustrates an oscillator constituting part of a continuous casting machine, e.g., a machine for the continuous casting of steel. Since the components of the machine other than the oscillator are conventional, only the oscillator and those other components of the machine which facilitate an understanding of the mounting and operation of the oscillator are shown.

The casting machine is assumed to be of the vertical or curved type and includes a continuous casting mold 30 having a casting passage 30*a*. However, the casting machine may also be of the inclined or horizontal type. The mold 30 is carried by a mold table 40, and the oscillator functions to reciprocate the mold table 40, and hence the mold 30, along a linear or curved path indicated by the double-headed arrow B.

The oscillator includes a drive shaft 1 which is rotatably mounted in a pair of pillow blocks 3. The pillow blocks 3 are secured, e.g., bolted, to a rigid base 4.

The shaft 1 has a first portion 1*a* and a second portion 1*b*. The shaft portion 1*a* is connected with a motor 20 which serves to drive the shaft 1 in rotation as indicated by the arrow C. The shaft portion 1*a* may, for instance, be coupled to the motor 20 via a gear coupling and a gear reducer.

The shaft 1 has an axis of rotation A1*a* which constitutes the longitudinal axis of the shaft portion 1*a*. The shaft portion 1*b* on the other hand, has a longitudinal axis A1*b* which is parallel to the axis A1*a* of the shaft portion 1*a* but is offset from the axis A1*a* by a distance "x". The shaft portion 1*b* is thus eccentric with respect to the shaft portion 1*a*, and the eccentricity is denoted by "x".

A bushing or sleeve 2 having a flange 2*a* surrounds the shaft portion 1*b*. The sleeve 2 is received in an anti-friction bearing 6 such as a roller bearing and is rotatable relative to the shaft 1 and its shaft portion 1*b*. The sleeve 2 and the inner race of the bearing 6 are urged into engagement with one another, e.g., by a press fit, so that the inner race and the sleeve 2 rotate as a unit. The outer race of the bearing 6, on the other hand, is fixed against rotation. The bearing 6 is movable in the directions indicated by the double-headed arrow B, and the outer race is secured to a push rod 5 which, in turn, is connected with a non-illustrated oscillator arm supporting the mold table 40.

The sleeve 2 has an axis of rotation corresponding to the longitudinal axis A1*b*of the shaft portion 1*b*. The outer diameter of the sleeve 2, however, has a longitudinal axis A2 which is offset from the axis A1*b* by a distance "y". The outer diameter of the sleeve 2 is thus eccentric with respect to the shaft portion 1*b*, and the eccentricity is denoted by "y". The longitudinal axis A2 of the outer diameter of the sleeve 2 parallels the longitudinal axes A1*a*, A1*b* of the respective shaft portions 1*a*, 1*b*.

The reference character "z" denotes the resultant of the eccentricities "x" and "y". The resultant eccentricity "z" is variable and may be changed by rotating the sleeve 2 relative to the shaft portion 1*b*.

In operation, the sleeve 2 is rotated relative to the shaft portion 1*b* until a desired resultant eccentricity "z" is obtained. The resultant eccentricity "z" may be read from a conventional, non-illustrated indicator mounted on the push rod 5 or the mold table 40. Once the desired resultant eccentricity "z" has been achieved, the sleeve 2 is fixed relative to the shaft portion 1*b* using a locking mechanism if necessary. When the shaft 1 now rotates, the outer race of the bearing 6 is caused to move up-and-down through a distance corresponding to the set resultant eccentricity "z". This, in turn, causes the push rod 5 and the oscillator arm to move up-and-down through the distance "z" as the shaft 1 rotates. As a result, the mold table 40 and the mold 30 reciprocate through the distance "z" during rotation of the shaft 1.

The shaft 1 accordingly functions to oscillate the mold 30. The magnitude of the oscillation stroke is "z" which is the resultant eccentricity of the sleeve 2 with respect to the shaft portion 1*a*. The magnitude "z" of the oscillation stroke can be changed by rotating the sleeve 2 relative to the shaft portion 1*b*, and hence relative to the shaft portion 1*a*.

Until now, there was no practical manner of changing the magnitude "z" of the oscillation stroke during rotation of the shaft 1. Thus, in present continuous casting machines, rotation of the shaft 1 is discontinued when the oscillation stroke is to be adjusted. The shaft 1, which is coupled to the sleeve 2 by a serration type coupling during rotation, is then released from the sleeve 2 and the latter is held in position by an hydraulically actuated jaw. Next, the shaft 1 is engaged with a low speed gear assembly and rotated to achieve the desired eccentricity "z".

Withdrawal of the continuously cast strand from the mold 30 must be interrupted when the shaft 1 is brought to a standstill since the mold 30 stops oscillating. Accordingly, adjustment of the oscillation stroke results in lost production time. Moreover, an excessive delay in resuming reciprocation of the mold 30 may make it impossible to re-start the continuously cast strand. Should this occur, additional production time, as well as materials and labor, are lost.

The invention makes it possible to change the magnitude "z" of the oscillation stroke in a practical manner both while the shaft 1 rotates and is at a standstill.

According to the invention, adjustment of the magnitude "z" of the oscillation stroke is achieved through the agency of a varying mechanism including a second motor 9. The motor 9 has an output element or output shaft which is mounted in, and is rotatable relative to, a supporting element or motor casing. The motor 9 is entirely conventional and may be an electric motor, a pneumatic motor or an hydraulic motor.

Power is supplied to the motor 9 via a junction or union 10 which connects the motor 9 with a non-illustrated power source. If the motor 9 is electrical, the union 10 is in the form of a slip ring assembly. On the other hand, for a pneumatic motor 9, the union 10 is a rotary union through which compressed air flows to the motor 9. Similarly, in the case of a hydraulic motor 9, the union 10 is in the form of a rotary union which supplies a pressurized hydraulic fluid such as oil to the motor 9.

As will be explained below, the motor 9 adjusts the magnitude "z" of the oscillation stroke by rotating the sleeve 2 relative to the shaft 1. In order to precisely adjust the position, and hence the eccentricity "z", of the sleeve 2 with respect to the shaft portion 1*a*, it is of advantage to rotate the shaft 2 at low rpm with high torque. To this end, a gear reducer 7 is interposed between the motor 9 and the sleeve 2. This gear reducer, which constitutes part of the varying mechanism for adjusting the oscillation stroke, is preferably a planetary gear reducers.

*However, gear reducer other than planetary can be used. It is further possible to use reducers other than gear type.

The gear reducer 7, which is entirely conventional, comprises a supporting member or housing which accommodates, and is rotatable relative to, a gear assembly, e.g., a planetary gear assembly. The input side of the gear assembly is coupled to the output shaft of the motor 9 for rotation therewith. On the other hand, the output side of the gear assembly is provided with an output member or output shaft 8 which is here in the form of a spline shaft. The spline shaft 8 is received in a recess formed in the shaft portion 1*b*, and the recess has grooves which cooperate with the splines of the spline shaft 8 to couple the spline shaft 8, and hence the gear assembly, to the drive shaft 1 for rotation with the latter. The output shaft of the motor 9 is thus coupled to the drive shaft 1 via the gear assembly and the spline shaft 8.

The housing of the gear reducer 7 is secured, e.g., bolted, to the flange 2*a* of the sleeve 2 as well as the casing of the motor 9. Accordingly, when the sleeve 2 is fixed relative to the drive shaft 1 and the latter rotates, the gear reducer 7 and the motor 9 rotate as a unit with the sleeve 2 and the shaft 1 while the motor 9 is inoperative. However, when power is supplied to the motor 9, the casing of the motor 9 is caused to rotate relative to the drive shaft 1 due to the fact that the output shaft of the motor 9 is coupled for rotation with the shaft 1. This causes the housing of the gear reducer 7 to rotate relative to the drive shaft 1 which, in turn, results in rotation of the sleeve 2 relative to the drive shaft 1. Rotation of the sleeve 2 relative to the drive shaft 1 operates to change the eccentricity "z" of the sleeve 2 with respect to the shaft portion 1*a* and hence to change the magnitude of the oscillation stroke.

Once the desired eccentricity "z" has been achieved and the motor 9 deactivated, the sleeve 2 must retain its position relative to the drive shaft 1 as the latter rotates. To this end, it is preferred to provide a locking mechanism for positively fixing the sleeve 2 relative to the shaft 1 when the desired eccentricity "z" has been obtained. The locking mechanism is here in the form of a brake, e.g., a disc brake, constituting part of the motor 9.

The motor 9 is operable independently of the motor 20 for the drive shaft 1 so that the motor 9 can rotate the sleeve 2 relative to the shaft 1 whether or not the motor 20 is operating and regardless of the operating speed of the motor 20. This makes it possible to efficiently and simply adjust the magnitude "z" of the oscillation stroke while the drive shaft 1 rotates or while the latter is at a standstill. Furthermore, the motor 9 may be reversible thereby allowing the sleeve 2 to be rotated either clockwise or counterclockwise as necessary to most quickly reach the new value of "z".

The motor 9 is controllable from a remote location such as the casting platform, and the rpm of the motor 9 may be steplessly varied. This makes it possible to achieve fully automatic, remote stepless adjustment of the oscillation stroke without interrupting an ongoing casting operation.

The spline shaft 8, gear reducer 7, motor 9 and union 10 are coaxial with, i.e., have the same longitudinal axis as, the shaft portion 1*b* of the drive shaft 1. Inasmuch as the eccentricity "x" of the shaft portion 1*b* with respect to the shaft portion 1*a* is small as compared to the diameters of the shaft portions 1*a* and 1*b*, the spline shaft 8, gear reducer 7, motor 9 and union 10 are then approximately coaxial with the shaft portion 1*a*. By virtue of this arrangement, the sleeve 2, the gear reducer 7, motor 9 and union 10 are disposed in-line thereby making it possible for the oscillator to have a compact design. Moreover, the in-line arrangement of the sleeve 2, gear reducer 7 and motor 9 permits the power requirements for the motor 9 to be reduced so that the latter may be small. This not only contributes to compact and reliable design of the oscillator but reduces capital costs and energy requirements as well. The size of the motor 9 may be further reduced by selecting the gear reducer 7 so as to have a high gear ratio.

In addition to serving for gear reduction, the gear reducer 7 may also function as a flywheel. This allows the power requirements for the motor 20 which drives the shaft 1 to be reduced.

The gear reducer 7 may be eliminated and the motor 9 replaced by a different type of motor capable of efficiently rotating the sleeve 2 relative to the drive shaft 1 without the intermediary of a separate gear reducer. For instance, the gear reducer 7 and motor 9 may be replaced by an hydraulic rotary actuator having a housing which accommodates, and is rotatable relative to, an hydraulic drive mechanism. The housing of the hydraulic actuator is secured, e.g., bolted, to the flange 2*a* of the sleeve 2 while the drive mechanism is coupled to the shaft 1 via the spline shaft 8. The union 10 is here a rotary union which supplies the hydraulic actuator with a pressurized hydraulic fluid such as oil.

Figure 2:
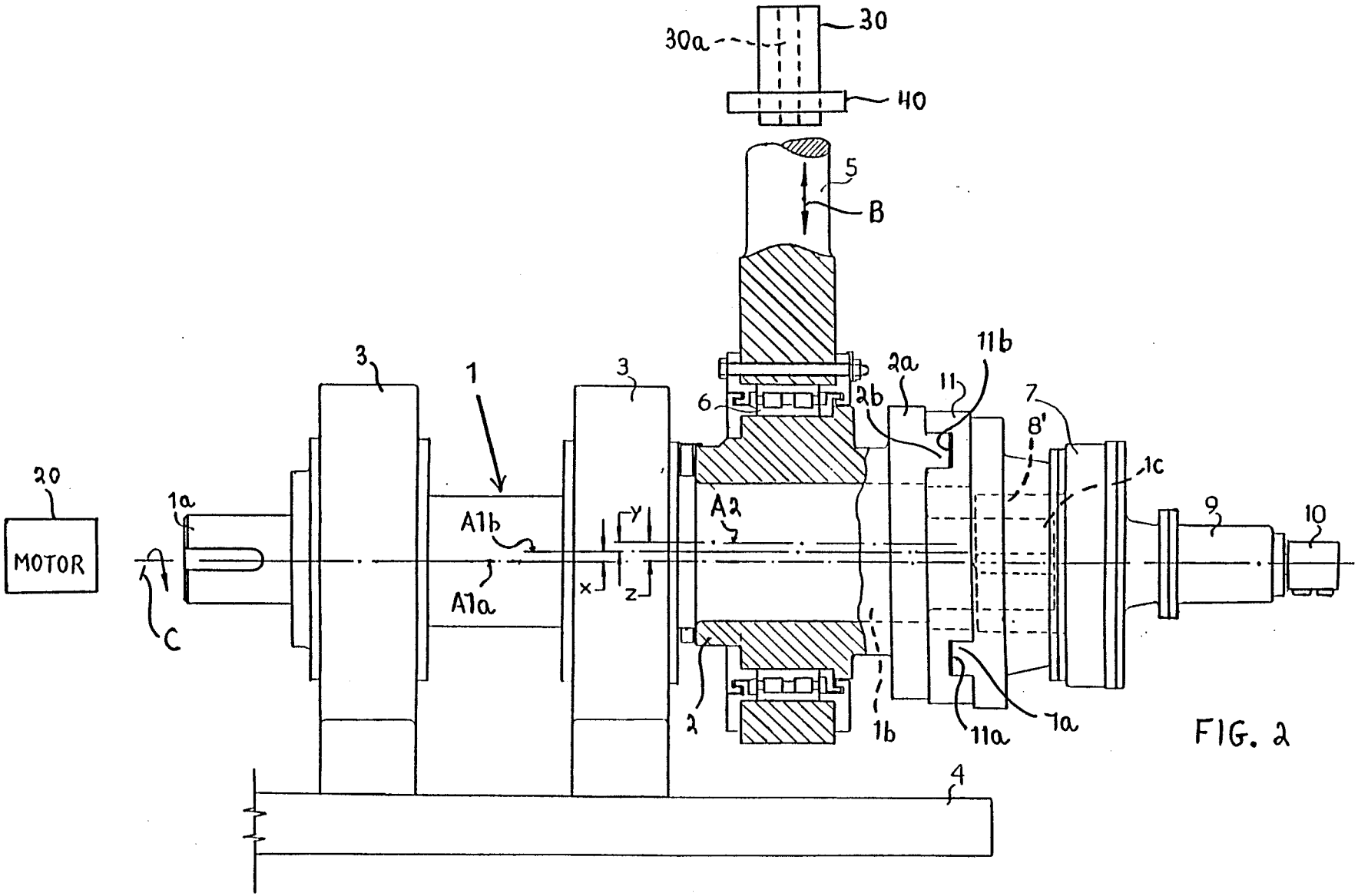
FIG. 2 is similar to FIG. 1 but shows another embodiment of an oscillator in accordance with the invention.

Referring to FIG. 2, the same reference numerals as in FIG. 1 are used to identify similar elements.

The oscillator of FIG. 2 differs from that of FIG. 1 in that the drive shaft 1 has an additional portion 1*c* which is located on the side of the shaft portion 1*b* remote from, and is coaxial with, the shaft portion 1*a*. The spline shaft 8 is replaced by a hollow output shaft 8' which receives the shaft portion 1*c* and is coupled, e.g., keyed, to the latter.

The oscillator of FIG. 2 further differs from that of FIG. 1 in that a double engagement coupling 11 is interposed between the gear reducer 7 and the sleeve 2. The coupling 11 is here in the form of a hollow double-slider or Oldham coupling which is provided with a pair of grooves 11*a* and 11*b*. The housing of the gear reducer 7 has a projection 7*a* which is slidably received in the groove 11*b* while the flange 2*a* of the sleeve 2 has a projection 11*b* which is slidably received in the groove 2*b*.

The coupling 11 has a passage which receives the shaft portion 1*c* in such a manner that the coupling 11 is rotatable relative to the shaft portion 1*c*. When the motor 9 is activated so that the casing of the motor 9 exerts a torque upon the housing of the gear reducer 7, the projection 7*a* is caused to slide along the groove 11*a* thereby causing the gear coupling 11 to rotate relative to the drive shaft 1. Due to rotation of the gear coupling 11, the projection 2*b* of the sleeve 2 slides along the groove 11*b* which, in turn, results in rotation of the sleeve 2 relative to the shaft 1. The motor 9 is deactivated once the sleeve 2 reaches a position corresponding to the desired magnitude "z" of the oscillation stroke.

The coupling 11 is preferably relatively rigid since this permits the magnitude "z" of the oscillation stroke to be adjusted with increased precision.

The coupling 11 is, of necessity, slightly eccentric with respect to the shaft portion 1*a* of the drive shaft 1. However, the coupling 11 makes it possible to position the output shaft 8', gear reducer 7, motor 9 and union 10 so that these are coaxial with the shaft portion 1*a* as shown in FIG. 2. This enables the dynamic balance of the oscillator to be improved and allows the service life to be increased.

In FIG. 2, it is again possible to eliminate the gear reducer 7 and to replace the motor 9 by an hydraulic rotary actuator.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. An oscillator for a continuous casting mold, comprising a rotary drive shaft having a first portion, and a second portion which is eccentric with respect to said first portion; a first motor for driving said drive shaft; a sleeve surrounding and rotatable relative to said second portion, said sleeve being eccentric with respect to both of said portions and being designed to transmit oscillatory motion to a continuous casting mold as said drive shaft rotates; and a varying mechanism for changing the oscillation stroke while said drive shaft rotates and while said drive shaft is at a standstill, said varying mechanism including a second motor having an output element, and a supporting element for said output element, and said elements being rotatable relative to one another, one of said elements being coupled to said sleeve for rotation therewith, and said sleeve being rotatable relative to the other of said elements so as to permit said second motor to rotate said sleeve relative to said second portion, said elements being at least approximately coaxial with said first portion.

2. The oscillator of claim 1, wherein said output element comprises an output shaft and said supporting element comprises a casing.

3. The oscillator of claim 1, wherein said one element is said supporting element.

4. The oscillator of claim 1, wherein said other element is coupled to said drive shaft for rotation therewith.

5. The oscillator of claim 4, wherein said other element is said output element.

6. The oscillator of claim 1, wherein said varying mechanism comprises a gear reducer between said second motor and said sleeve.

7. An oscillator for a continuous casting mold, comprising a rotary drive shaft having a first portion, and a second portion which is eccentric with respect to said first portion; a first motor for driving said drive shaft; a sleeve surrounding and rotatable relative to said second portion, said sleeve being eccentric with respective to both of said portions and being designed to transmit oscillatory motion to a continuous casting mold as said drive shaft rotates; and a varying mechanism for changing the oscillation stroke while said drive shaft rotates and while said drive shaft is at a standstill, said varying mechanism including a second motor having an output element, and a supporting element for said output element, and said elements being rotatable relative to one another, one of said elements being coupled to said sleeve for rotation therewith, and said sleeve being rotatable relative to the other of said elements so as to permit said second motor to rotate said sleeve relative to said second portion, said elements being at least approximately coaxial with said first portion, and said varying mechanism further including a gear reducer between said second motor and said sleeve, said gear reducer having an output member, and a supporting member for said output member, and said members being rotatable relative to one another, one of said members being coupled to said sleeve and to said one element for rotation therewith, and the other of said members being coupled to said other element for rotation with the latter.

8. The oscillator of claim 7, wherein said one element is said supporting element and said one member is said supporting member.

9. The oscillator of claim 7, wherein said other member is coupled to said drive shaft for rotation therewith.

10. The oscillator of claim 9, wherein said one element is said output element and said one member is said output member.

11. The oscillator of claim 7, wherein said supporting element comprises a casing, said supporting member comprises a housing, and said output element and output member respectively comprise output shafts.

12. The oscillator of claim 7, wherein said members are essentially coaxial with said elements.

13. The oscillator of claim 12, wherein said members and said elements are coaxial with said second portion.

14. The oscillator of claim 12, wherein said members and said elements are coaxial with said first portion.

15. The oscillator of claim 14, wherein said varying mechanism comprises a double engagement coupling between said gear reducer and said sleeve.

16. The oscillator of claim 15, wherein said double engagement coupling is in direct engagement with said sleeve and said one member, and the latter is in direct engagement with said one element.

17. The oscillator of claim 7, wherein said one member is in direct engagement with said sleeve and said one element.

18. The oscillator of claim 6, wherein said gear reducer is a planetary gear reducer.

19. The oscillator of claim 1, wherein said one element is in direct engagement with said sleeve.

20. The oscillator of claim 1, wherein said elements are coaxial with said second portion.

21. The oscillator of claim 1, wherein said elements are coaxial with said first portion.

22. The oscillator of claim 21, wherein said varying mechanism comprises a double engagement coupling between said second motor and said sleeve.

23. The oscillator of claim 1, wherein said second motor is an electric motor.

24. The oscillator of claim 1, wherein said second motor is a pneumatic motor.

25. The oscillator of claim 1, wherein said second motor is an hydraulic motor.

26. The oscillator of claim 25, wherein said second motor is an hydraulic rotary actuator.

27. The oscillator of claim 1, wherein said second motor is operable independently of said first motor.

28. The oscillator of claim 1, wherein said second motor is reversible.

29. The oscillator of claim 1, comprising locking means for maintaining said sleeve in a predetermined position relative to said second portion.

* * * * *